United States Patent [19]

Galgana et al.

[11] Patent Number: 4,740,127

[45] Date of Patent: Apr. 26, 1988

[54] SOLID FUEL BOILER/INCINERATOR FUEL FEEDER

[75] Inventors: Russell J. Galgana, Clarksville; Patrick F. Mahoney, Rensselaer, both of N.Y.; Gordon L. Sutin, Dundas, Canada

[73] Assignee: Smith & Mahoney, P.C., Albany, N.Y.

[21] Appl. No.: 890,764

[22] Filed: Jul. 25, 1986

[51] Int. Cl.[4] ..... F23K 3/00

[52] U.S. Cl. ..... 414/173; 110/255; 198/550.13; 198/550.3; 198/601; 198/720; 414/187; 414/327

[58] Field of Search ..... 414/173, 177, 145, 187, 414/209, 211, 304, 325, 326, 327; 198/550.3, 580, 720, 566, 601, 550.13; 110/165 R, 170, 255

[56] References Cited

U.S. PATENT DOCUMENTS

| | | | |
|---|---|---|---|
| 1,031,073 | 7/1912 | Kissel | 414/326 X |
| 1,739,887 | 12/1929 | Corman | 414/327 X |
| 2,122,708 | 7/1938 | Banfield | 110/165 R X |
| 3,148,784 | 9/1964 | Pickrell, Jr. | 414/145 |
| 3,715,041 | 2/1973 | Peters | 414/327 X |
| 3,785,304 | 1/1974 | Stookey | 110/255 X |
| 4,020,956 | 5/1977 | Van Hille | 414/327 X |
| 4,602,572 | 7/1986 | Giaier et al. | 414/187 X |

FOREIGN PATENT DOCUMENTS 903257 7/1982 U.S.S.R. .

*Primary Examiner*—Joseph E. Valenza
*Assistant Examiner*—David A. Bucci
*Attorney, Agent, or Firm*—Hoffmann & Baron

[57] ABSTRACT

A fuel feeder for feeding refuse fuel to a boiler/incinerator which includes a pair of opposed inclined conveyors defining end boundaries of the conveyor, the conveyors being independently driven so that the fuel required for variable firing rates in plural boilers can independently be supplied.

5 Claims, 2 Drawing Sheets

SOLID FUEL BOILER/INCINERATOR FUEL FEEDER

BACKGROUND OF THE INVENTION

Solid waste as same is collected in a municipal waste operation is being used more frequently as boiler fuel in commercial generation of steam and electricity. The waste is generally preliminarily processed before its employment as fuel, such processing including magnetic removal of ferrous objects and the shredding of the waste material. The shredded waste is then fed in metered quantities thereof to the boiler furnace. Difficulties can be encountered with respect to altering the feed rate with precision and quickly to take into account the variations as exist in the composition of the solid waste fuel with the corresponding variations of heating value of same. This in turn can effect the boiler steam generation rate in undesirable manner. In addition to providing the flexibility with which a waste solid fuel feeding operation can be controlledly altered to accommodate fuel heating value changes, it should provide for division and delivery of two separate, metered fuel feed flows from a single feed source. This requirement stems from the common practice of installing two smaller boilers in a steam/power generation plant rather than a single larger boiler in order to achieve greater overall plant reliability.

SUMMARY OF THE INVENTION

The present invention relates to highly reliable, readily and easily fabricated apparatus which is used to feed a metered flow of solid waste fuel to a boiler/incinerator.

In accordance with the invention, the apparatus includes a hopper designed such as to receive and accumulate an inflow of shredded waste from a municipal waste collection, with the hopper being sited in close proximity to the boiler/incinerator units to be supplied therefrom. The hopper is defined by front and rear wall structures and a pair of endless belt conveyors arranged in divergently upwardly inclined dispositions with the conveyors serving as the end wall defining means of the hopper. Solid waste from a source, e.g., a shredding operation can be delivered into the open top of the hopper and to build up a stock of waste fuel for meeting the demand from the steam generator for fuel. Replenishment of the fuel stock is made as required.

The belt conveyors which in one convenient form are disposed at an angle of about 60° to a horizontal datum plane have upper straight run courses which travel upwardly from bottom to top of the hopper so that flight members thereon scoop out and transport a layer of waste fuel from the bottom of the waste stock to the top of the hopper and discharge same out hopper discharge openings adjacent the top turnaround courses of the conveyor travel paths. The conveyors are powered individually by separately associated variable speed drive means. Thus and since the conveyor flight members are of predetermined dimension, the fuel feed rate is effectively controlled and readily alterable to vary same by controlling the speed of the conveyor.

The conveyors each have lower or return straight run courses which terminate at a lower turnaround course. These lower turnaround courses and pass in close spaced adjacency one with the other at the bottom of the hopper. Since the respective conveyors constitute hopper end wall means, it is desirable that waste spillage be precluded along these courses. For such purposes, there is provided a spillage control pan underlaying each conveyor lower straight run course, spaced therefrom and in lateral expanse wider than its associated conveyor. Each spillage control pan extends downwardly from proximate the hopper discharge opening associated with the conveyor, and follows in course correspondence with the conveyor including following the lower turnaround course with the pan of one conveyor terminating in merged juncture with the pan of the other conveyor at a location intermediate the two conveyor turnaround courses. The merged terminal portions of the two pans constitute a bottom closure for the hopper. By this arrangement any spillage from the bottom of the hopper effectively is prevented. The spillage control pans also have side pan portions to further insure avoidance of fuel spillage from the hopper.

The advantages and further features of the invention will be made more apparent from the following detailed description to be given hereinafter and will be described in terms of such features of construction, combination of elements and arrangement of parts as will exemplified in the construction set forth and the scope of the invention will be indicated in the claims.

BRIEF DESCRIPTION OF THE DRAWINGS

A fuller understanding of the nature of objects of the invention will be had from the following detailed description taken in conjunction with the accompanying drawings in which.

Throughout the following description, like reference numerals are used to denote like parts in the drawings.

DESCRIPTION OF THE PREFERRED EMBODIMENTS

Figure 1:
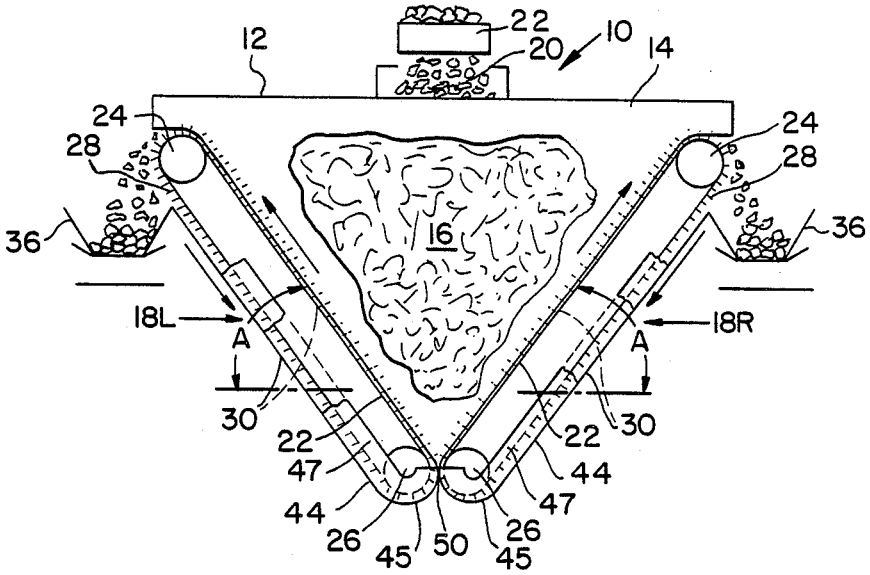
FIG. 1 is front elevational view of apparatus for feeding a metered flow of waste fuel to a boiler or incinerator, certain details of construction of the conveyor assemblies and structural supporting features for the hopper not being shown as same are conventional and unnecessary for full and proper understanding of the invention, the side wall portion of the spillage control pans being partly broken away for clarity of depiction.

Referring now in detail to FIG. 1, the apparatus 10 of the invention includes a relatively large hopper 12 of V-shape as viewed from the front and of generally uniform width as viewed from the side. The hopper boundaries are defined in one dimension by a pair of upright front and rear spaced walls 14, 16 and in the other direction by left and right hand oppositely, inclinedly disposed conveyors 18L and 18R, respectively, and in this regard the conveyors serve as the hopper end walls. Walls 14, 16 are fabricated components and the particular supports and other structural components associated with secured placement of the walls in the required field location are not shown. In like manner, certain known constructional features of the conveyor are of commonly known character and therefore not illustrated.

Figure 3:
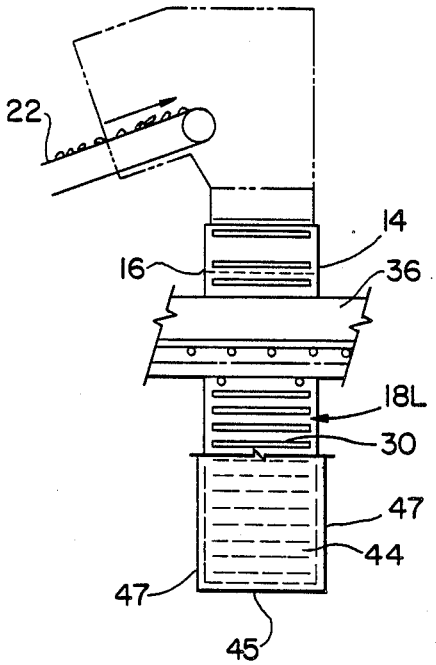
FIG. 3 is a left end elevational view of FIG. 1.

Processed, shredded waste material 20 as seen further from FIG. 3, is delivered from a source to the hopper in a single hopper filling stream by means of traveling belt conveyor 22, the said material having cascading discharge from conveyor 22 into the open top of the hopper. Conveyor 22 will in most practices operate on a continuous basis to keep the hopper filled with enough fuel to meet the demand to be expected in the steam generator plant, although it also should be capable of cyclic operation as well. Each of the conveyors 18L, 18R is an endless belt type, i.e., it traverses an endless course represented by an upper longitudinal straight course (traveling upwardly from hopper bottom to top), a lower longitudinal straight course and upper and lower turnaround courses at which the respective top and bottom pulley members 24, 26 operate. As the conveyors traverse the associated top turnaround course, they pass adjacent hopper discharge openings 28 which will be discussed further later on in the description.

The conveyors which are effectively disposed at an angle A of substantially 60° to a horizontal datum plane, are each provided with laterally or crosswise disposed flight members 30, the flight members being, e.g., slat-like components functioning to transport fuel material in front thereof along a transported course out of the hopper. The flight members 30 may be oriented substantially perpendicular to the face of the conveyor belt on which they are mounted as with conveyor 18L or they may be forwardly inclined in the direction of conveyor travel as with conveyor 18R. If forwardly inclined, the angulation may be at about one-half the angle at which the conveyor is inclined.

Figure 2:
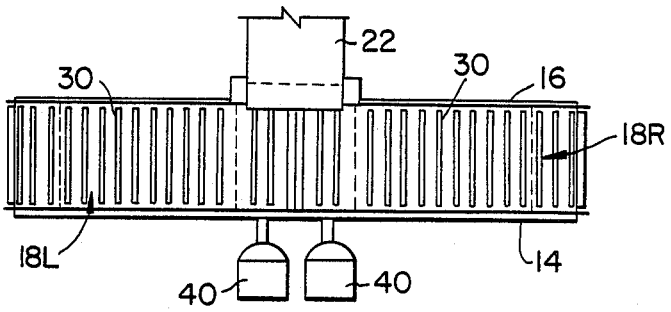
FIG. 2 is a top plan view of FIG. 1 showing additionally the conveyor variable drive means which is not shown elsewhere in the drawings.

In operation, the conveyors 18L, 18R follow the travel courses indicated. From the lower turnaround courses, the conveyors in transiting to an upper straight run, scoop up fuel at the bottom of the hopper and the flights transport this fuel as boiler feed up to the top of the hopper. As each conveyor 18L, 18R is in its top turnaround course travel, it passes its associated discharge opening 28 and the fuel gravity feeds off the conveyor and falls onto a chute conveyor 36 by means of which the fuel is carried directly to the nearby and particular one of the steam generator furnaces intended to be supplied therefrom. The fuel metering rate can be controlled accurately in response to a given demand inasmuch as the volume feed per unit of conveyor speed is a function of this speed, the effective height of the flight members 30 and the flight member width. Conveyor speed can be altered instantly to greater or lesser magnitude and this can be done for one conveyor independently of the other since each has its own independent variable speed drive means such as drive motors 40 depicted in FIG. 2. The use of independent conveyor drives also allows shut down of one feed operation if its associated boiler is shut down while at the same time maintaining the other fully operational.

To preclude spillage of material from the bottom of the hopper and to provide for bottom closure of same, there are provided spillage control pans 44 for each conveyor 18L and 18R. These pans 44 each include a bottom plate 45 and vertically disposed side plates 47. The bottom plates 45 which are laterally wider than the conveyor, underlie the lower straight longitudinal courses of the conveyors and extend down from proximate the associated hopper discharge opening in conveyor following course including correspondence with the lower conveyor turnaround course where the two bottom plates have intersecting merger one with the other at a common juncture intermediate the two lower turnaround courses, i.e., centrally of the two lower conveyor pulleys 26 as at point 50 in FIG. 1. The two bottom plates in converging to a single point of merger form a short vertical baffle, tangent to the arc of each conveyor tail assembly. This tangential departure results in a gradually increasing clearance space for the conveyor flights in the travel direction and thereby reducing or eliminating the possibility of feed jams. The short vertical height of the merged pan structure minimizes the possibility of material bridging above the baffle. The pan side plates 47 which complete the pan closure structure extend upwardly from the side margins of plates 45 and have expanse from the lower turnaround courses at point 50 upwardly along the conveyor lower straight courses to an upper terminus thereof slightly below the location of the discharge openings, the height of the side plates being a little less than one-half the vertical height of the respective conveyors 18L and 18R.

While there is above disclosed only some embodiments of the feeder apparatus of the present invention, it will be understood that various modifications can be made within the scope of the disclosed invention.

What is claimed is:

1. Apparatus for feeding a metered flow of solid fuel to a boiler/incinerator operation, said apparatus comprising an upright pair of spaced apart walls constituting respective front and rear hopper defining boundaries, and a pair of belt conveyors each traversing an endless travel course and having upstanding flight members extending crosswise thereon, said conveyors being arranged in divergently upwardly inclined dispositions, each conveyor having an upper elongated straight run course defining with that of the other opposed hopper end boundaries, said front, rear and end boundaries defining a hopper chamber for holding a collection of solid waste fuel therein, the upper straight run course of each conveyor traveling from bottom to top in said hopper chamber and being operable to transport material from the bottom of a stock of solid waste contained in said chamber, each conveyor transiting a turnaround course at the top of the hopper and discharging the material transported thereby through an associated hopper discharge opening adjacent said turnaround course, and each conveyor having a lower straight run course and a lower turnaround course at the bottom of the hopper, the lower turnaround courses of said conveyors being in close spaced adjacency one with the other, and separate variable speed drive motors connected to each of said conveyors for separating and independently variably controlling the speed of each of said conveyors and correspondingly the rate at which solid waste is transported by a conveyor to its associated hopper discharge opening independently of the rate of which the other conveyor transports waste from said hopper.

2. The apparatus of claim 1 further comprising a material spillage control pan including a plate underlaying each conveyor lower course spaced therefrom and extending downwardly from proximate the hopper discharge opening associated therewith and in following correspondence to the lower turnaround course of such associated conveyor to termination in merged juncture with the plate of the other conveyor pan intermediate the two conveyor lower turnaround courses, the merging terminal portions of said plates defining a hopper bottom closure.

3. The apparatus of claim 2 in which each conveyor material spillage control pan is laterally wider than its associated conveyor.

4. The apparatus of claim 2 in which each conveyor material spillage control pan includes side plates extending upwardly from the associated bottom plate side margins.

5. The apparatus of claim 1 further comprising separate transport conveyors traveling in courses adjacent and below the respective two hopper discharge openings for carrying off the discharged material to a point of use therefor.

* * * * *